US008408538B2

(12) United States Patent
Miyazaki et al.

(10) Patent No.: US 8,408,538 B2
(45) Date of Patent: Apr. 2, 2013

(54) DISCHARGE MECHANISM AND IMAGE FORMING APPARATUS

(75) Inventors: Megumi Miyazaki, Kanagawa (JP); Yukihiro Ichiki, Kanagawa (JP); Motoyuki Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/303,266

(22) Filed: Nov. 23, 2011

(65) Prior Publication Data

US 2012/0286470 A1 Nov. 15, 2012

(30) Foreign Application Priority Data

May 13, 2011 (JP) ..... 2011-108626

(51) Int. Cl.
*B65H 29/70* (2006.01)

(52) U.S. Cl. ..... 271/188; 271/209

(58) Field of Classification Search ..... 271/188, 271/209

See application file for complete search history.

(56) References Cited

U.S. PATENT DOCUMENTS

| | | | | |
|---|---|---|---|---|
| 6,089,567 | A * | 7/2000 | Yatsuhashi et al. | 271/314 |
| 6,181,908 | B1 * | 1/2001 | Leemhuis et al. | 399/406 |
| 6,190,070 | B1 * | 2/2001 | Urban et al. | 400/636.3 |
| 7,677,561 | B2 * | 3/2010 | Matsumoto et al. | 271/272 |
| 2006/0157922 | A1 | 7/2006 | Carter et al. | |
| 2006/0163803 | A1 * | 7/2006 | Izuchi et al. | 271/272 |

FOREIGN PATENT DOCUMENTS

| | | |
|---|---|---|
| JP | 03-111370 A | 5/1991 |
| JP | 08-073098 A | 3/1996 |

* cited by examiner

*Primary Examiner* — David H Bollinger
(74) *Attorney, Agent, or Firm* — Sughrue Mion, PLLC

(57) ABSTRACT

A discharge mechanism includes a rotary shaft, a roller member, and a deforming unit. The roller member has a peripheral surface that is coaxial with the rotary shaft, rotates together with the rotary shaft, and discharges a medium that is in contact with the peripheral surface. The deforming unit deforms the medium in such a way that a part of the medium, the part being not in contact with the peripheral surface, passes through a position that is closer to the rotary shaft than the peripheral surface is. A part of the peripheral surface, the part being in contact with the medium, is continuously displaced in an axial direction and in a rotation direction of the rotary shaft when the roller member is rotated.

20 Claims, 15 Drawing Sheets

DISCHARGE MECHANISM AND IMAGE FORMING APPARATUS

CROSS-REFERENCE TO RELATED APPLICATIONS

This application is based on and claims priority under 35 USC 119 from Japanese Patent Application No. 2011-108626 filed May 13, 2011.

BACKGROUND

Technical Field

The present invention relates to a discharge mechanism and an image forming apparatus.

SUMMARY

According to an aspect of the invention, a discharge mechanism includes a rotary shaft, a roller member, and a deforming unit. The roller member has a peripheral surface that is coaxial with the rotary shaft, rotates together with the rotary shaft, and discharges a medium that is in contact with the peripheral surface. The deforming unit deforms the medium in such a way that a part of the medium, the part being not in contact with the peripheral surface, passes through a position that is closer to the rotary shaft than the peripheral surface is. A part of the peripheral surface, the part being in contact with the medium, is continuously displaced in an axial direction and in a rotation direction of the rotary shaft when the roller member is rotated.

BRIEF DESCRIPTION OF THE DRAWINGS

Exemplary embodiment(s) of the present invention will be according to detail based on the following figures, wherein.

DETAILED DESCRIPTION

1. First Exemplary Embodiment

1-1. Overall Structure

In the exemplary embodiments described below, the term "medium" refers to a sheet-like object on which an image forming unit 500 forms an image. A medium is typically a sheet of paper or an envelope made of paper. However, a medium may be a plastic sheet.

In the present specification and the drawings, the directions are represented by using the X-, Y-, and Z-axes that are perpendicular to each other. The XYZ coordinate system, which is represented by the X-, Y-, and Z-axes, is right-handed. The X-axis represents the X component. The direction in which the X component increases along the X-axis will be referred to as the X(+) direction, and the direction in which the X component decreases along the X-axis will be referred to as the X(−) direction. The same applies to the Y- and Z-axes.

Figure 1:
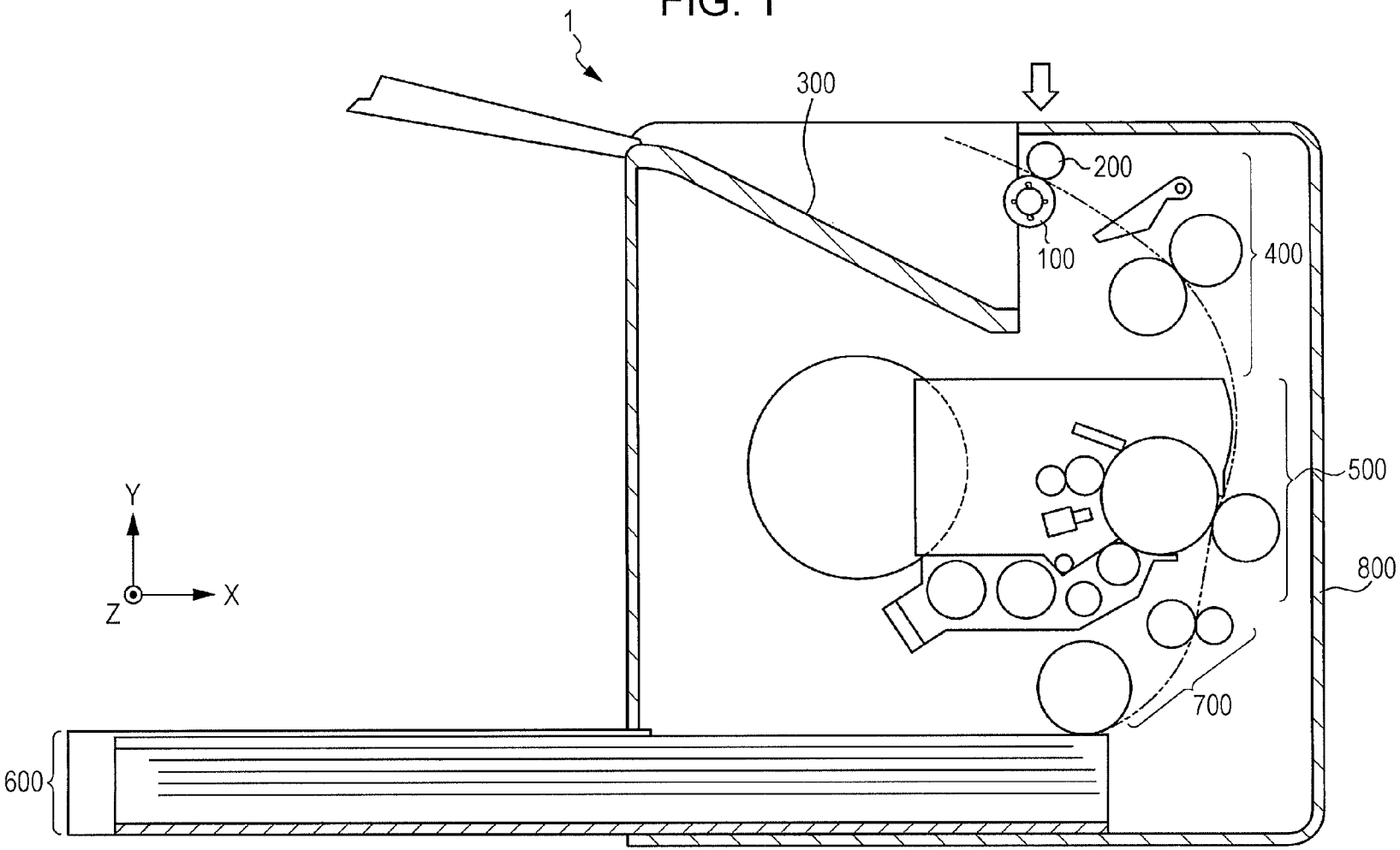
FIG. 1 illustrates the overall configuration of an image forming apparatus according to a first exemplary embodiment of the present invention.

FIG. 1 illustrates the overall configuration of an image forming apparatus 1 according to a first exemplary embodiment of the present invention. FIG. 1 is a schematic view illustrating the inside of the image forming apparatus 1 seen in the Z(−) direction. A feeding unit 600 includes a container for containing media such as sheets or envelopes. The container is inserted into a housing 800 of the image forming apparatus 1, and the media contained in the container become ready to be supplied.

A transport unit 700 picks up the media one by one from the feeding unit 600 and transports one of the media to the image forming unit 500.

The image forming unit 500 forms an image on a surface of the medium by using an electrophotographic process using developer. To be specific, the image forming unit 500 includes a photoconductor that carries a latent image, an exposure device that exposes the photoconductor to light and causes the photoconductor to carry a latent image, a developer supply device that supplies developer to the latent image on the photoconductor, and a transfer device that transfers a developed image from the photoconductor to the medium. The developer includes, for example, a black toner. The image forming unit 500 is an example of an image forming unit that forms an image on a medium.

A fixing unit 400 heats the medium and fuses a toner that has been attached to a surface of the medium by the image forming unit 500 and thereby fixes an image.

A discharge unit 100 and an auxiliary unit 200 nip the medium, on which the fixing unit 400 has fixed the image, therebetween and discharge the medium to a stacker unit 300. The discharge unit 100 is an example of a discharge mechanism that discharges a medium on which an image forming unit has formed an image.

The stacker unit 300 stacks and holds media that have been discharged by the discharge unit 100.

1-2. Configuration of Discharge Unit

Figure 2A:
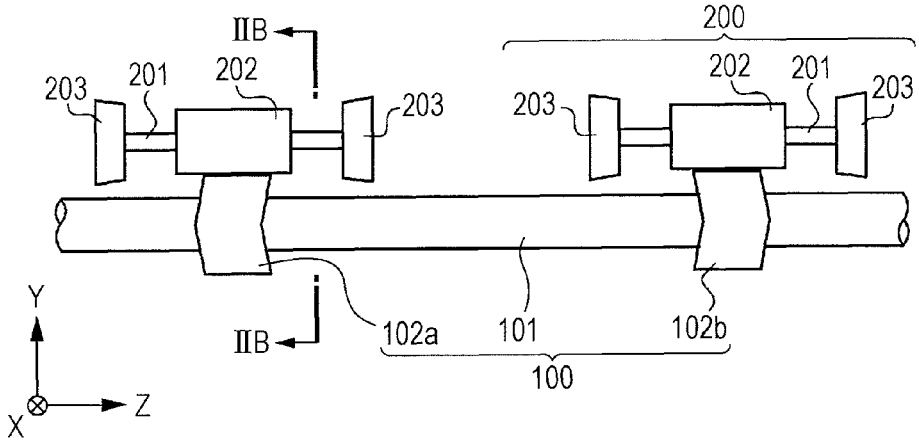
FIGS. 2A and 2B illustrate the configuration of a discharge unit and the vicinity of the discharge unit according to the first exemplary embodiment.
Figure 2B:
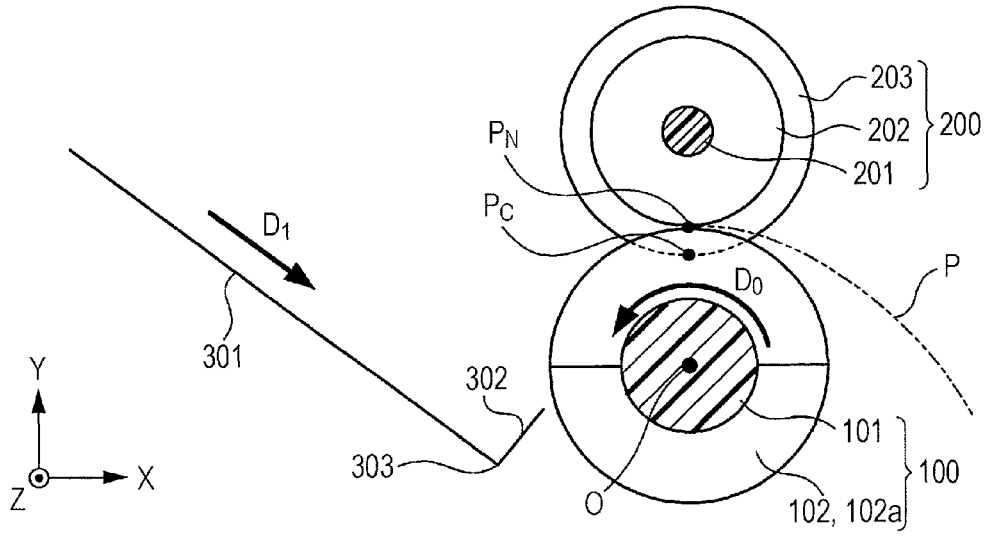

FIGS. 2A and 2B illustrate the configuration of the discharge unit 100 and the vicinity of the discharge unit 100 according to the first exemplary embodiment. FIG. 2A is a schematic view of the discharge unit 100 and the auxiliary unit 200 seen in the X(+) direction. FIG. 2B is a sectional view of the discharge unit 100, the auxiliary unit 200, and the stacker unit 300 taken along line IIB-IIB of FIG. 2A and seen in the Z(−) direction. The discharge unit 100 includes a discharge rod 101 and discharge rollers 102. The discharge rod 101 is a rod-like member that is rotated around an axis O by a drive unit (not shown). That is, the drive unit is an example of a rotation unit that rotates the discharge rod 101 (rotary shaft) in a rotation direction corresponding to the discharge direction of a medium.

Two discharge rollers 102*a* and 102*b* are attached to the discharge rod 101 so as to be separated from each other in the axial direction (hereinafter, the discharge rollers 102*a* and 102*b* will be collectively referred to as "discharge rollers 102" when it is not necessary to distinguish between these two rollers). The discharge rollers 102 are each an example of a roller member having a peripheral surface that is coaxial with the discharge rod 101 (rotary shaft), rotates together with the discharge rod 101, and discharges a medium that is in contact with the peripheral surface. The discharge rollers 102 and auxiliary rollers 202 of the auxiliary unit 200 (described below) nip a medium therebetween, the discharge rollers 102 rotate in the direction of arrow $D_0$ around the axis O of the discharge rod 101, and thereby discharge the medium to the stacker unit 300.

Figure 3:
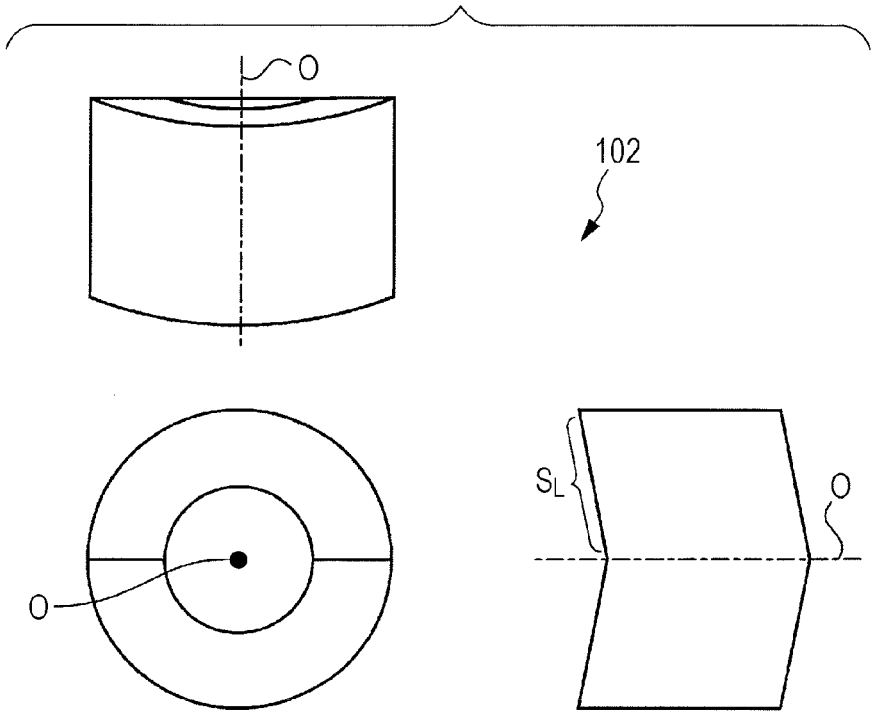
FIG. 3 illustrates the shape of a discharge roller.

FIG. 3 illustrates the shape of one the discharge rollers 102. As illustrated in FIG. 3, the discharge roller 102 has a shape formed of two oblique cylinders that are cut along their axes and that are joined together along the cut surfaces so as to be symmetric to each other about the cut surfaces. An inclined surface $S_L$ illustrated in FIG. 3 represents a part of an end surface of the discharge roller 102, and the inclined surface $S_L$ is inclined with respect to the axis O. Therefore, the discharge roller 102 has a dogleg shape in a side view seen in a certain direction, and end surfaces of the discharge roller 102 each have a fan-like shape in a side view seen in a direction that is displaced by 90 degrees from the certain direction. The end surfaces of the discharge roller 102 are parallel to each other. Therefore, the length of the peripheral surface of the discharge roller 102 in the axial direction is constant regardless of a position thereon.

The discharge roller 102 may be manufactured by actually cutting oblique cylinders in half and bonding the cut oblique cylinders. Alternatively, the discharge roller 102 may be manufactured by cutting a material into this shape. The material of the discharge roller 102 is not particularly limited, and may be, for example, a resin or a rubber. The discharge roller 102 may be manufactured together with the discharge rod 101 by injection-molding such a material. In the examples described below, the discharge rod 101 and the discharge roller 102 are integrally formed by injection-molding a resin. By integrally forming the discharge roller 102 and the discharge rod 101, a process of inserting the discharge rod 101 into the discharge roller 102 is omitted, and thereby limitations on the shape of the discharge rod 101 are reduced.

The discharge rollers 102*a* and 102*b* are disposed on the discharge rod 101 at different positions in the axial direction. The discharge rollers 102*a* and 102*b* are symmetric to each other about a plane perpendicular to the axis. Therefore, the discharge rollers 102*a* and 102*b* are examples of two roller members having parts that are in contact with a medium and the distance between the parts in the axial direction continuously changes when the discharge rollers 102*a* and 102*b* are rotated.

Referring back to FIGS. 2A and 2B, the auxiliary unit 200 includes auxiliary rods 201, the auxiliary rollers 202, and corrugation rollers 203. The auxiliary rods 201 are rod-like members disposed so as to be separated from the discharge rod 101 in the Y(+) direction of by a predetermined distance. The axes of the auxiliary rods 201 are parallel to the axis of the discharge rod 101. The auxiliary rollers 202, which rotate around the auxiliary rods 201, are disposed on the auxiliary rod 201 at positions facing the discharge rollers 102*a* and 102*b*. The diameter of the auxiliary rollers 202 is larger than the diameter of the auxiliary rod 201.

Figure 4:
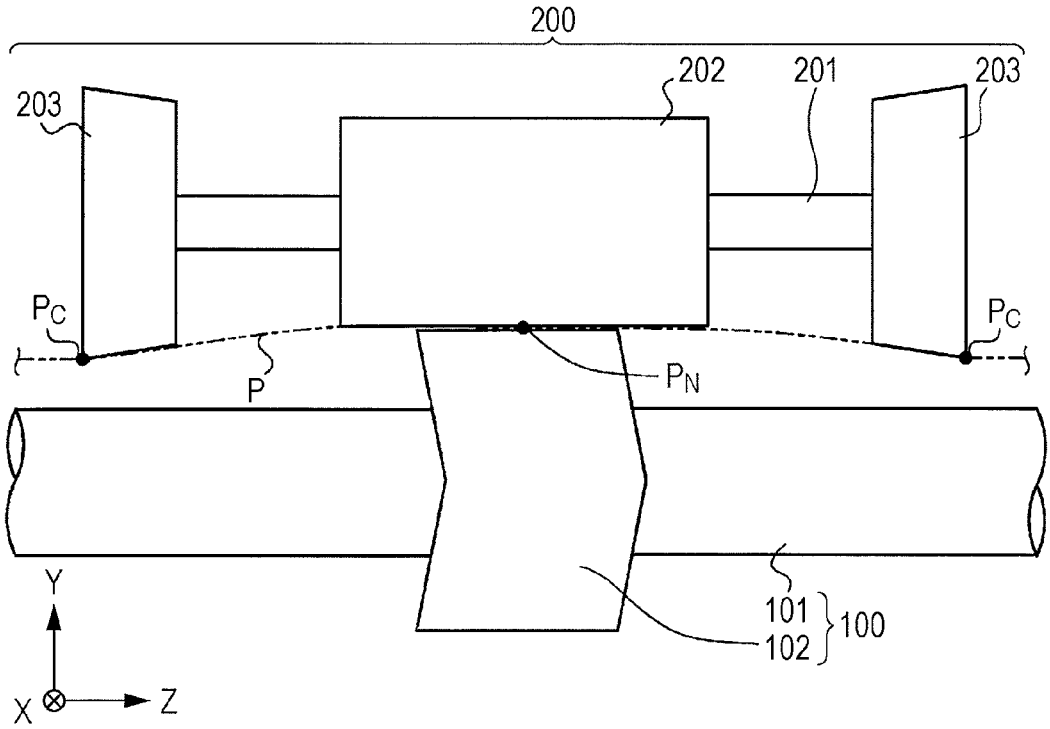
FIG. 4 illustrates the discharge unit and an auxiliary unit.

The corrugation rollers 203 are disposed on the auxiliary rods 201 and rotate around the auxiliary rods 201. FIG. 4 illustrates the discharge unit 100 and the auxiliary unit 200. FIG. 4 is an enlarged view of one of the discharge rollers 102 (to be specific, the discharge roller 102*b*) illustrated in FIG. 2A and the vicinity of the discharge roller 102.

Two corrugation rollers 203 are disposed on the auxiliary rod 201 so as to correspond to one discharge roller 102. The corrugation rollers 203 are disposed in such a way that the discharge roller 102 is interposed therebetween in the axial direction.

The auxiliary roller 202 moves together with the discharge roller 102 that faces the auxiliary roller 202. The auxiliary roller 202 and the discharge roller 102 nip a medium P therebetween and discharge the medium P to the stacker unit 300. A point $P_N$ illustrated in FIG. 4 is a point at which a medium P is nipped between the peripheral surfaces of the discharge roller 102 and the auxiliary roller 202. A point $P_C$ illustrated in FIG. 4 is closer to the discharge rod 101 than the point $P_N$, which is on the peripheral surface of the discharge roller 102. That is, the auxiliary roller 202 is an example of roller body that nips a medium between the auxiliary roller 202 and the discharge roller 102 (roller member).

As described above, because the length of the peripheral surface of the discharge roller 102 in the axial direction is constant regardless of a position thereon, the length of a region over which the auxiliary roller 202 (roller body) and the discharge roller 102 (roller member) nip the medium P therebetween is constant while the discharge roller 102 rotates.

Because the corrugation rollers 203 press the medium P toward the discharge rod 101 up to the point $P_c$, wave-shaped ridges (hereinafter referred to as corrugations) extending in the discharge direction of the medium P are formed on the medium P.

Figure 5:
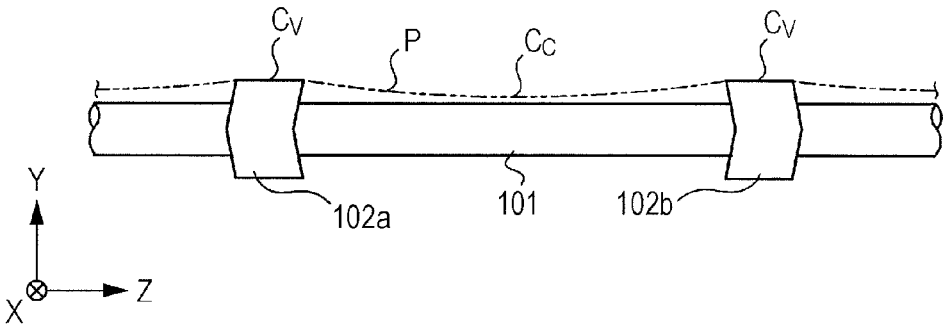
FIG. 5 illustrates how corrugations are provided on a medium that is located on discharge rollers.

FIG. 5 illustrates how corrugations are provided on a medium P that is located on the discharge rollers 102. The corrugation rollers 203 press the medium P that is nipped between the discharge rollers 102 and the auxiliary rollers 202. Therefore, as illustrated in FIG. 5, parts of the medium P that are in contact with the discharge rollers 102 have a shape that protrudes (convex) in the Y(+) direction and parts of the medium P that are not in contact with the discharge rollers 102 have a shape that is recessed (concave) in the Y(−) direction. Thus, ridges extending in the discharge direction on the medium P are formed on the medium P by the corrugation rollers 203. Hereinafter, the vertex of the convex shape will be referred to as a convex portion $C_V$, and the vertex of the concave shape will be referred to as a concave portion $C_C$. That is, the corrugation roller 203 is an example of a deforming unit that deforms a medium so that part of a medium that is not in contact with the peripheral surface of the roller member passes through a position that is closer to the rotary shaft than the peripheral surface is.

Referring back to FIGS. 2A and 2B, the stacker unit 300 illustrated in FIG. 2B is made by bending a plate at an edge 303. The stacker unit 300 includes a bottom portion 301 and a side portion 302. Media that have been nipped between the discharge rollers 102 and the auxiliary rollers 202 and have been discharged are stacked on the bottom portion 301. Because the bottom portion 301 is inclined with respect to the direction of gravity (Y(−) direction), the media stacked on the bottom portion 301 tend to slide down in the direction of arrow $D_1$. The side portion 302 supports ends of the media, and thereby prevents the media from sliding down further in the direction of arrow $D_1$.

1-3. Operation of Discharge Unit

Figure 6:
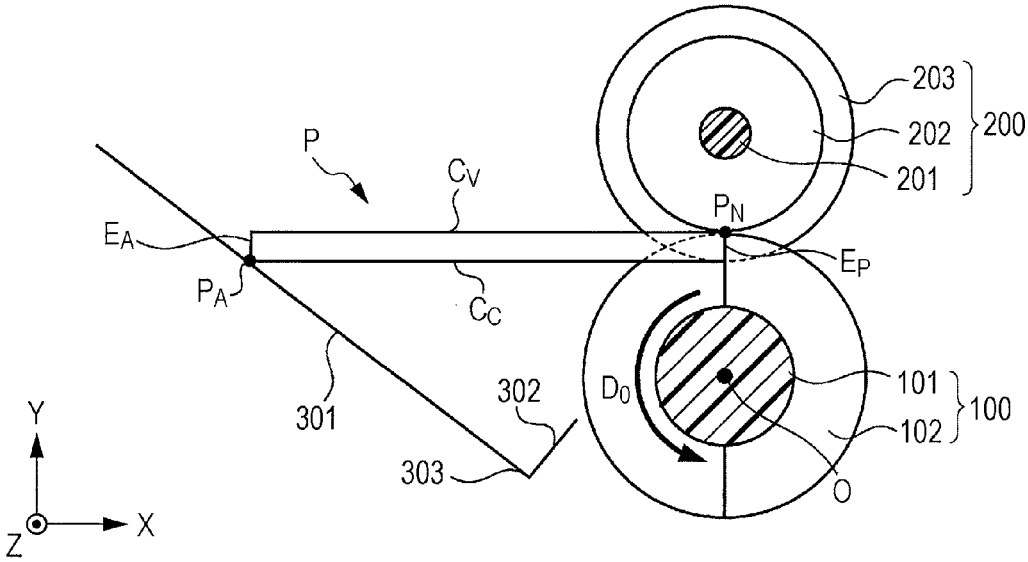
FIG. 6 illustrates a state in which a medium has passed through a point at which a medium was nipped between a discharge roller and an auxiliary roller.

The operation of the discharge unit 100 will be described. FIG. 6 illustrates a state in which a medium P has passed through a point $P_N$ at which the medium P was nipped between the discharge roller 102 and the auxiliary roller 202. In the state illustrate in FIG. 6, the trailing end $E_p$ of the medium P has passed through the point $P_N$, the medium P has become separated from the auxiliary roller 202, and the medium P is located on the discharge roller 102. A leading end $E_A$ of the medium P abuts against the bottom portion 301 of the stacker unit 300 at a point $P_A$, and the medium P receives a reaction force from the bottom portion 301 in the X(+) direction, which is opposite to the discharge direction (X(−) direction). Due to the corrugations, the medium P has the convex portions $C_V$ and the concave portions $C_C$, which are ridges and grooves extending in the discharge direction. Therefore, the medium P is not liable to be bent in the X-axis direction as illustrated in FIG. 6.

Figure 7A:
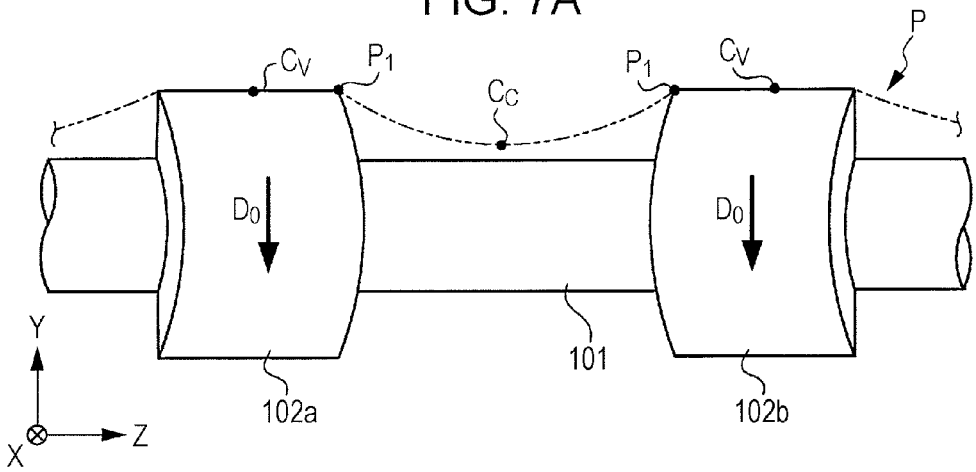
FIGS. 7A to 7C illustrate how contact points between the discharge rollers and a medium are displaced in directions in which a discharge rod extends.
Figure 7B:
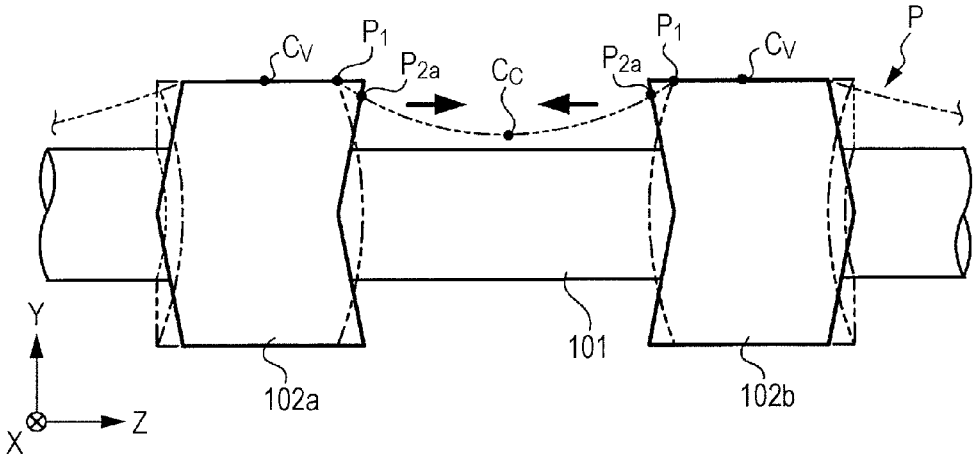
Figure 7C:
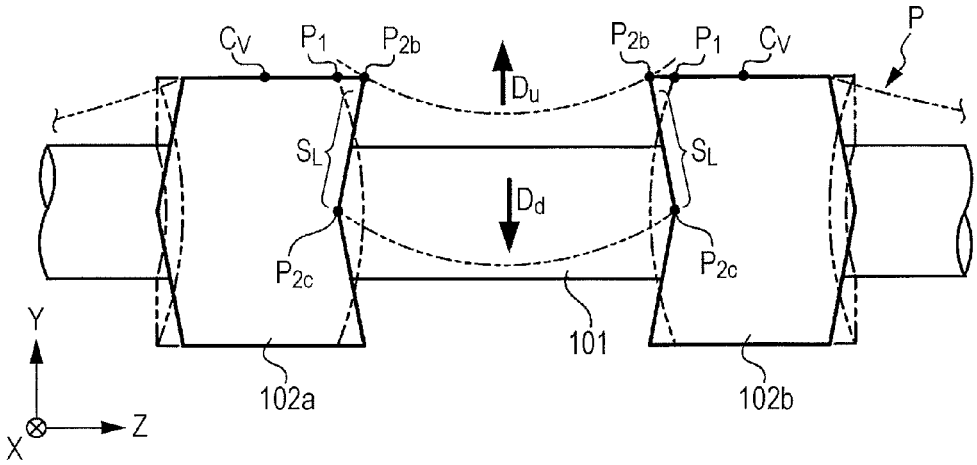

FIGS. 7A to 7C illustrate how contact points between the discharge rollers 102 and a medium P are displaced in directions in which the discharge rod 101 extends. For ease of description, in FIGS. 7A to 7C, it is supposed that the discharge rollers 102*a* and 102*b* are disposed at positions that are closer to each other in the axial direction than those illustrated in FIG. 5.

As illustrated in FIG. 7A, the concave portion $C_c$ of the medium P is supported by two points $P_1$ between which the concave portion $C_c$ is located. Every time the discharge rollers 102 rotate by 90 degrees in the direction of arrow $D_0$, the positions of the discharge rollers 102 change as illustrated in FIG. 7B. That is, while the two discharge rollers 102 rotate by 90 degrees in the direction of arrow $D_0$, the apexes of the end surfaces of the discharge rollers 102 in the Y(+) direction are displaced along the Z-axis and become closer to the concave portion $C_c$ than the points $P_1$ are. That is, the peripheral surfaces of the discharge rollers 102 are examples of a peripheral surface having a part that is in contact with the medium P and that is continuously displaced in the axial direction and in the rotation direction of the discharge rod 101 (rotary shaft) when the discharge rollers 102 are (the roller member is) rotated.

In FIG. 7B, each area between the points $P_1$ and $P_{2a}$ is an area in which the medium P before the discharge rollers 102 rotate and the discharge rollers 102 that have rotated overlap each other. Therefore, as the discharge rollers 102 rotate, parts of the medium P that have been located between the points $P_1$ and $P_{2a}$ is pushed out. That is, the medium P is moved as the discharge rollers 102 rotate.

Points $P_{2b}$ illustrated in FIG. 7C are the contact points between the discharge rollers 102 and the medium P when the medium P resists rotation of the discharge rollers 102 and the medium P does not move at all in the X(−) direction but rather moves in the Y(+) direction. In FIG. 7C, if the angle between the direction of arrow $D_0$ (rotation direction) and the inclined surfaces $S_L$ of the opposite end surfaces of the discharge rollers 102 were smaller than a first threshold, the medium P would slip at contact points between the medium P and the discharge rollers 102, so that rotational driving force would not be transmitted to the medium P and the concave portion $C_c$ would be raised in the direction of arrow $D_u$ (Y(+) direction). That is, if the inclination of the inclined surface $S_L$ were too small, the medium P would not be discharged.

Points $P_{2c}$ illustrated in FIG. 7C are contact points at which the discharge rollers 102 and the medium P contact each other when the medium P does not slip at the contact points with the rotating discharge rollers 102 and the medium P moves in the direction of arrow $D_d$ as the discharge rollers 102 rotate. If the angle between the direction of arrow $D_0$ (rotation direction) and the inclined surfaces $S_L$ were equal to or larger than a second threshold that is larger than the first threshold, the medium P would not slip at all at the contact points between the discharge rollers 102 and the medium P, so that the medium P would be discharged in the direction of arrow $D_d$ while being trapped at the contact points with the discharge rollers 102. That is, if the inclination of the inclined surface $S_L$ were too large, the medium P would be discharged without slipping at all at the contact points with the discharge rollers 102.

The angle between the inclined surfaces $S_L$ and the direction of arrow $D_0$ is adjusted to a value that is between those of the two cases described above. Therefore, the medium P is discharged as the discharge rollers 102 rotate while slipping at the contact points with the discharge rollers 102. The angle may be arbitrarily set as long as the medium P does not continuously slip over the discharge rollers 102 and fails to be discharged at all. That is, the angle may be adjusted so that the medium P does not slip at all at the contact points with the discharge rollers 102 and is discharged. However, by adjusting the angle to a value that is between those of the two cases described above, the contact points between the medium P and the discharge rollers 102 are continuously displaced and the points to which force is applied to the medium P are dispersed, and thereby the probability of the medium P being damaged is reduced.

Figure 8:
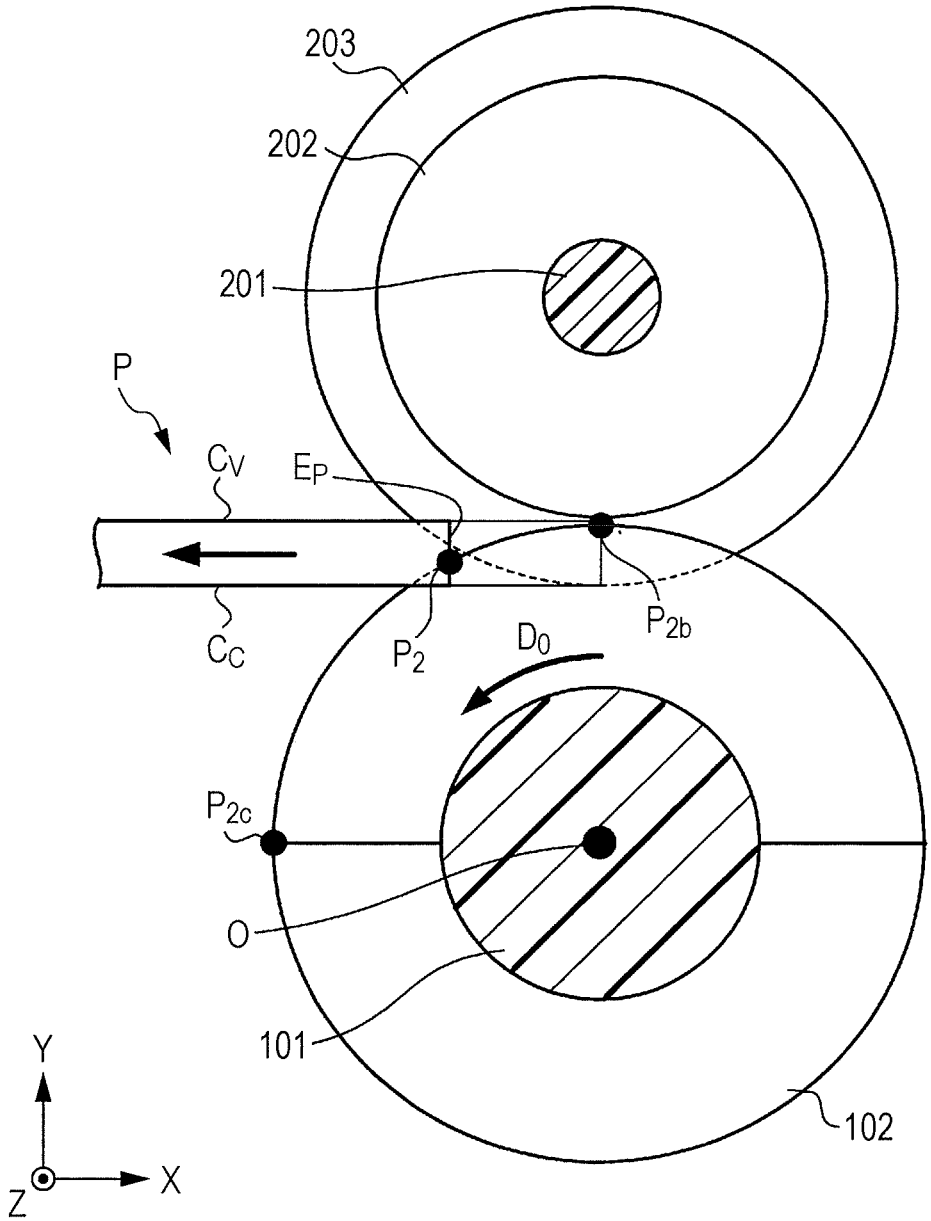
FIG. 8 illustrates how a trailing end of a medium is discharged by the discharge roller.

FIG. 8 illustrates how the trailing end $E_P$ of a medium P is discharged by the discharge roller 102. That is, the trailing end $E_P$ of the medium P, which has been in contact with the discharge roller 102 at the point $P_1$, is pushed in the X(−) direction as the discharge roller 102 rotates in the direction of arrow $D_0$. During this time, a contact point at which the discharge roller 102 is in contact with the trailing end $E_P$ of the medium P is displaced from the point $P_1$ to the point $P_2$.

If roller members were to have a regular cylindrical shape, the end surfaces of the roller members would not be displaced in the axial direction when the roller members rotate. Therefore, even if the medium P were corrugated, the roller members would not pinch the medium P from both sides in the axial direction, so that rotational driving force would not be transmitted to the medium P and the contact portions may slip, and as a result the medium P may not be discharged.

In contrast, in the case of the discharge rollers 102 described above, when the discharge rollers 102 rotate, contact positions at which the discharge rollers 102 are in contact with the medium P are displaced in the axial direction of the discharge rod 101, and the discharge rollers 102 pinch the concave portion $C_C$ of the medium P from both sides in the axial direction. Therefore, as compared with the case where the medium P is not corrugated, the medium P is more likely to receive frictional force from the discharge rollers 102. Accordingly, the discharge rollers 102 push the trailing end $E_P$ of the medium P in the discharge direction, and thereby the performance of discharging a medium is improved from before.

The shape of a cross section of each of the discharge rollers 102 along a plane perpendicular to the axis is circular, and therefore there are no steps on the peripheral surface of the discharge roller 102. Therefore, as compared with a roller having a non-circular cross section along a plane perpendicular to the axis, the probability of the medium P being damaged by the rotating peripheral surface of the discharge roller 102 is reduced. Moreover, the contact position at which the discharge roller 102 is in contact with the trailing end $E_P$ of the medium P when the discharge roller 102 discharges the medium p is continuously displaced in the axial direction of the discharge rod 101, so that the probability of the medium P being damaged is reduced as compared with the case where the contact position is not displaced.

The length of a region over which the auxiliary roller 202 and the discharge roller 102 nip the medium P therebetween in the axial direction does not change while the discharge roller 102 rotates. Therefore, as compared with the case where the length changes, the pressure that the auxiliary roller 202 applies to the discharge roller 102 as the discharge roller 102 rotates is not liable to change. As a result, a load applied to the medium P that is nipped between the discharge roller 102 and the auxiliary roller 202 does not change sharply, so that the probability of the medium P being damaged by the auxiliary roller 202 and the discharge roller 102 is reduced. As compared with the case where the length changes, backlash of the auxiliary roller 202 and noise generated due to the backlash are reduced.

2. Second Exemplary Embodiment

2-1. Configuration of Discharge Unit

Figure 9:
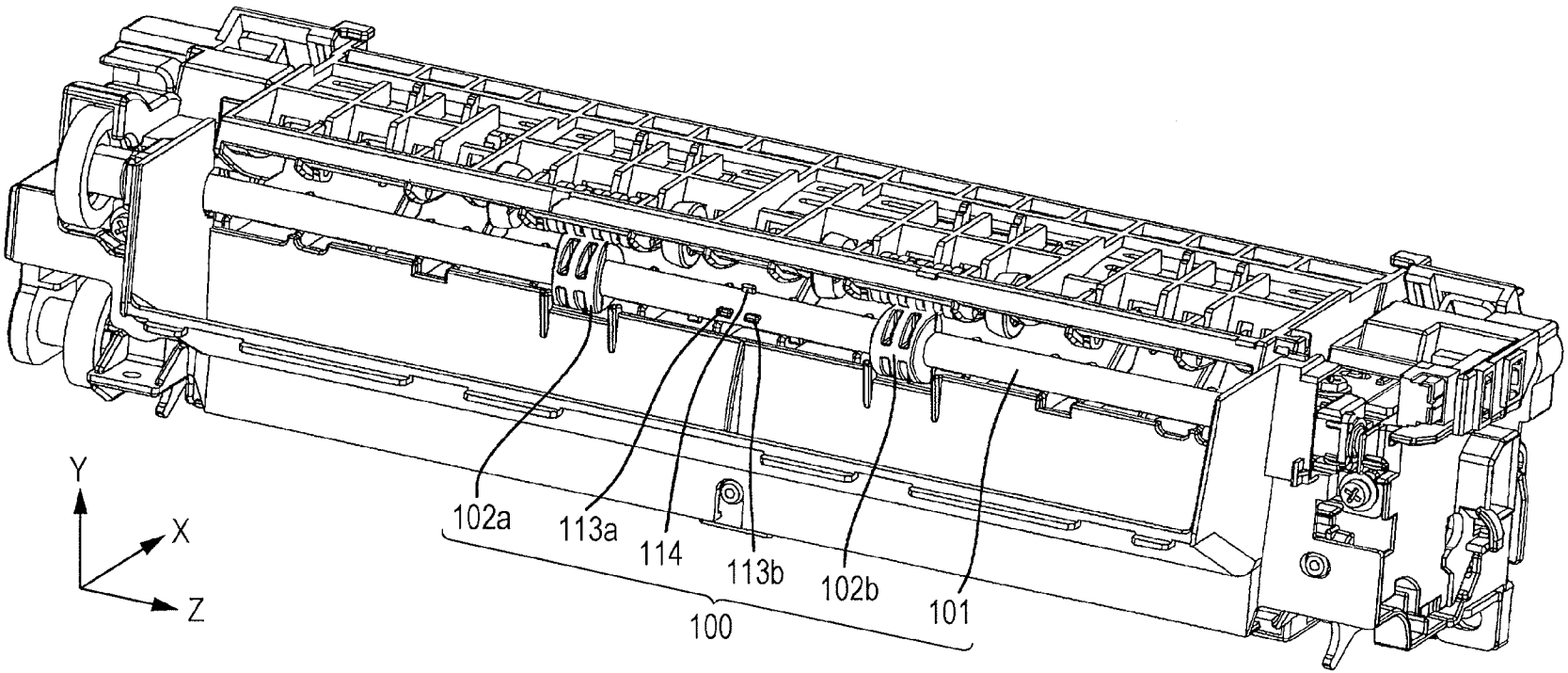
FIG. 9 is a perspective view of a discharge unit of an image forming apparatus according to a second exemplary embodiment of the present invention.

FIG. 9 is a perspective view of a discharge unit 100 of an image forming apparatus 1 according to a second exemplary embodiment of the present invention. The discharge unit 100 according to the second exemplary embodiment has a configuration that is the same as that of the discharge unit 100 according to the first exemplary embodiment, and further includes first protrusions 111 (not shown in FIG. 9), second protrusions 112 (not shown in FIG. 9), third protrusions 113, and a fourth protrusion 114. The image forming apparatus 1 according to the second exemplary embodiment will be described below with emphasis on the difference between the second exemplary embodiment and the first exemplary embodiment.

Figure 10A:
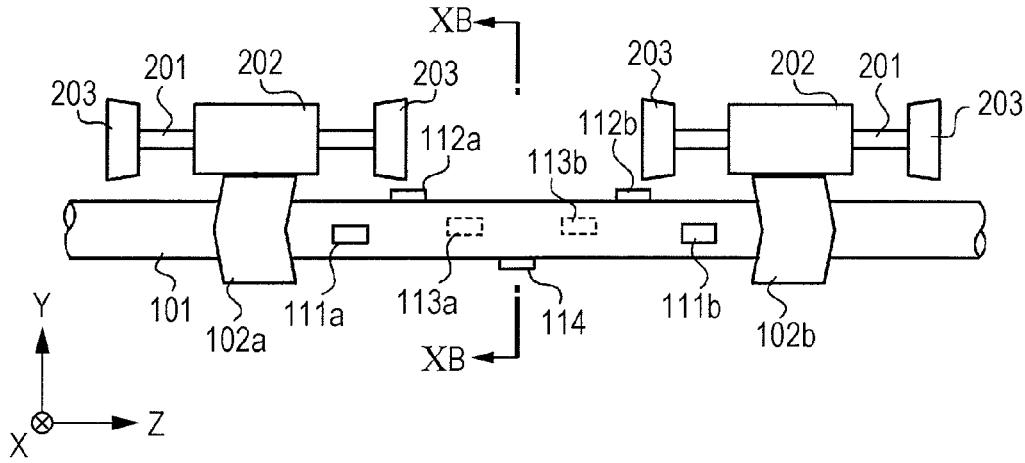
FIGS. 10A and 10B illustrate the configuration of the discharge unit and the vicinity of the discharge unit according to the second exemplary embodiment.
Figure 10B:
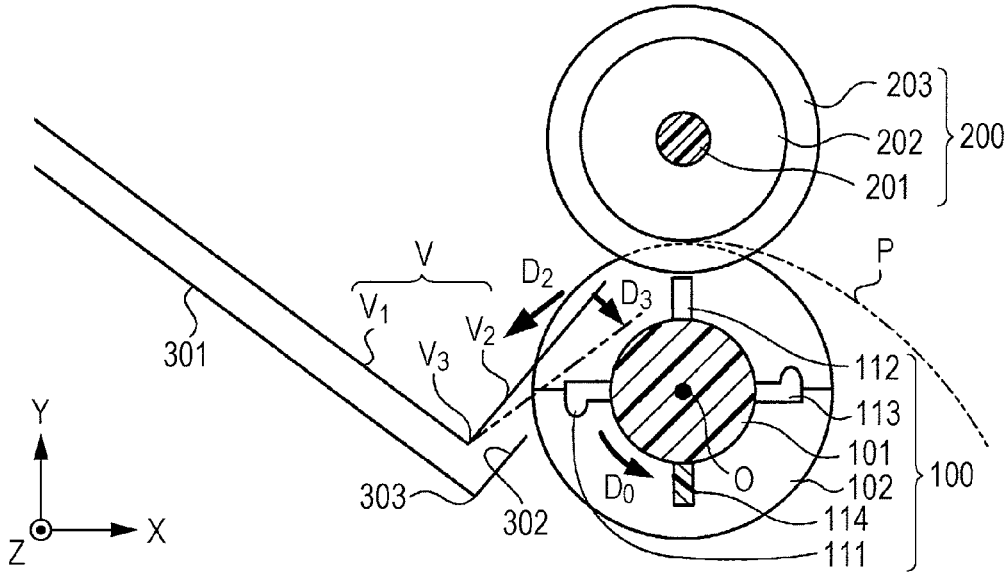

FIGS. 10A and 10B illustrate the configuration of the discharge unit 100 and the vicinity of the discharge unit 100 according to the second exemplary embodiment. FIG. 10A is a schematic view illustrating the configuration seen in the X(+) direction, and FIG. 10B is a sectional view of the configuration taken along line XB-XB of FIG. 10A and seen in the Z(−) direction.

The discharge unit 100 includes the discharge rod 101, the discharge rollers 102, the first protrusions 111, the second protrusions 112, the third protrusions 113, and the fourth protrusion 114.

The first protrusions 111, the second protrusions 112, the third protrusions 113, and the fourth protrusion 114 (hereinafter collectively referred to as "protrusions") are disposed on the discharge rod 101 in a region between the discharge rollers 102*a* and 102*b*. Therefore, these protrusions rotate around the axis O as the discharge rod 101 rotates.

The distance from the axis O of the discharge rod 101 to the distal end of a protrusion is smaller than the radius of the discharge roller 102 (to be precise, the radius of a circular cross section of the discharge roller 102 along a plane perpendicular to the axis O). In other words, each of the protrusions has a radius of gyration that is smaller than the radius of the discharge roller 102. That is, each of these protrusions is an example of a protrusion for which the distance from the axis of the rotary shaft to the distal end of the protrusion is smaller than the distance from the axis to the peripheral surface of the roller member.

Here, an envelope V, which is a medium that is nipped between the discharge rollers 102 and the auxiliary rollers 202 and is discharged, will be described. The envelope V is contained in the feeding unit 600 in an unsealed state, the image forming unit 500 forms character images such as those representing name and address on the front side of the envelope V, and the envelope V is discharged by the discharge unit 100.

Figure 11:
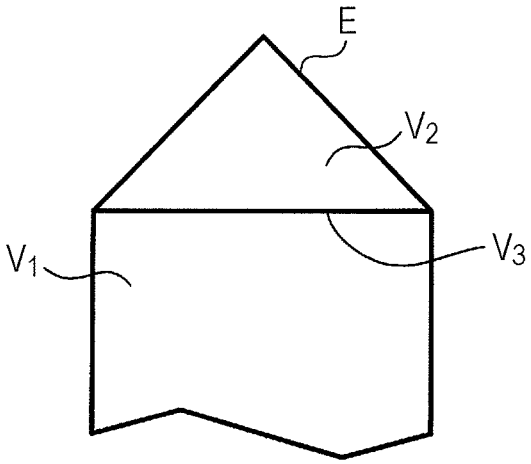
FIG. 11 illustrates the configuration of an envelope.

FIG. 11 illustrates the configuration of the envelope V. The envelope V has two parts, i.e., an envelope body $V_1$ and a flap $V_2$, which are divided by a folding line $V_3$. The envelope V is sealed by folding the flap $V_2$ along the folding line $V_3$ and sticking the flap $V_2$ to the envelope body $V_1$. The shape of the flap $V_2$ illustrated in FIG. 11 is a triangle (isosceles triangle) having the folding line $V_3$ as the base.

The envelope V is not sealed when the envelope V is discharged by the discharge unit 100, and the flap $V_2$ is not folded toward the envelope body $V_1$ along the folding line $V_3$. If the envelope V already has a bend that is downwardly convex (in the Y(−) direction) along the folding line $V_3$, the envelope V may be held on the stacker unit 300 in a state in which the envelope V is bent along the folding line $V_3$ as illustrated in FIG. 10B. In this case, the envelope body $V_1$ extends along the bottom portion 301 and the flap $V_2$ extends along the side portion 302.

2-2. Configuration of Protrusions

2-2-1. Arrangement of Protrusions in Rotation Direction

The fourth protrusion 114 is disposed at the center of a region of the discharge rod 101 between the discharge rollers 102*a* and 102*b* in the axial direction (Z-axis direction). The discharge rod 101 rotates in the direction of arrow $D_0$. First protrusions 111*a* and 111*b* are disposed a quarter of the way around the discharge rod 101 (90 degrees) backward from the fourth protrusion 114 in the rotation direction. (Hereinafter, the first protrusions 111*a* and 111*b* will be collectively referred to as the "first protrusions 111".) The first protrusion 111*a* is disposed in the Z(−) direction from the first protrusion 111*b*.

Second protrusions 112*a* and 112*b* are disposed a quarter of the way around the discharge rod 101 (90 degrees) backward from the first protrusions 111 in the rotation direction indicated by arrow $D_0$. (Hereinafter, the second protrusions 112*a* and 112*b* will be collectively referred to as the "second protrusions 112".) The second protrusion 112*a* is disposed in the Z(−) direction from the second protrusion 112*b*.

Third protrusions 113*a* and 113*b* are disposed a quarter of the way around the discharge rod 101 (90 degrees) backward from the second protrusions 112 in the rotation direction. (Hereinafter, the third protrusions 113*a* and 113*b* will be collectively referred to as "third protrusions 113".) The third protrusion 113*a* is disposed in the Z(−) direction from the third protrusion 113*b*.

The fourth protrusion 114 is disposed a quarter of the way around the discharge rod 101 (90 degrees) backward from the third protrusions 113 in the rotation direction. That is, in a direction opposite to the rotation direction of the discharge rod 101, the first protrusions 111, the second protrusions 112, the third protrusions 113, and the fourth protrusion 114 are arranged in this order with an angle corresponding to a quarter of the way around the discharge rod 101 (90 degrees) therebetween. In other words, in the region of the discharge rod 101 between the discharge rollers 102*a* and 102*b*, four types of protrusions are disposed at four different positions with respect to the rotation direction of the discharge rod 101.

At least one of the four types of protrusions has a hook. Here, the term "hook" refers to a part of a protrusion that projects in the rotation direction from the distal end of the protrusion, which is an end separated away from the discharge rod 101. In the present exemplary embodiment, the first protrusions 111 and the third protrusions 113 each have a hook, but the second protrusions 112 and the fourth protrusion 114 do not have a hook. The details of the hook will be described below.

2-2-2. Arrangement of Protrusions in Axial Direction

Figure 12:
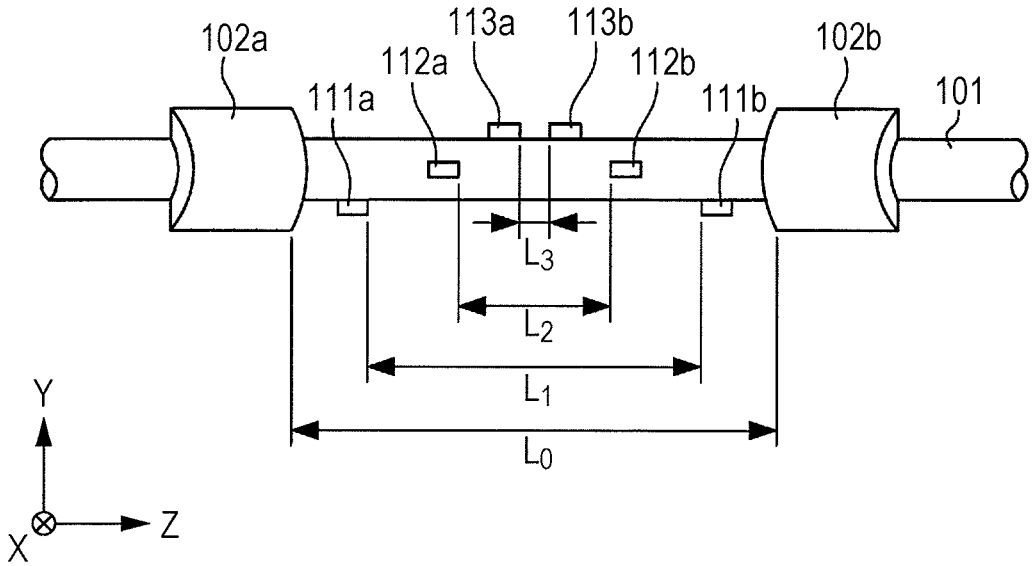
FIG. 12 illustrates the arrangement of protrusions in the axial direction.

FIG. 12 illustrates the arrangement of the protrusions in the axial direction (Z-axis direction). The length of the region of the discharge rod 101 between the discharge rollers 102*a* and 102*b* changes as described above. A length $L_0$ is the largest distance from a surface of the discharge roller 102*a* on the Z(+) side to a surface of the discharge roller 102*b* on the Z(−) side. The length $L_0$ is the distance between the points $P_1$ illustrated in FIGS. 7A to 7C.

A length $L_1$ is the distance from a surface of the first protrusion 111*a* on the Z(+) side to a surface of the first protrusion 111*b* on the Z(−) side. A length $L_2$ is the distance from a surface of the second protrusion 112*a* on the Z(+) side to a surface of the second protrusion 112*b* on the Z(−) side. A length $L_3$ is the distance from a surface of the third protrusion 113*a* on the Z(+) side to a surface of the third protrusion 113*b* on the Z(−) side. The lengths $L_0$, $L_1$, $L_2$, and $L_3$ have a relationship such that $L_0>L_1>L_2>L_3$.

Figure 13:
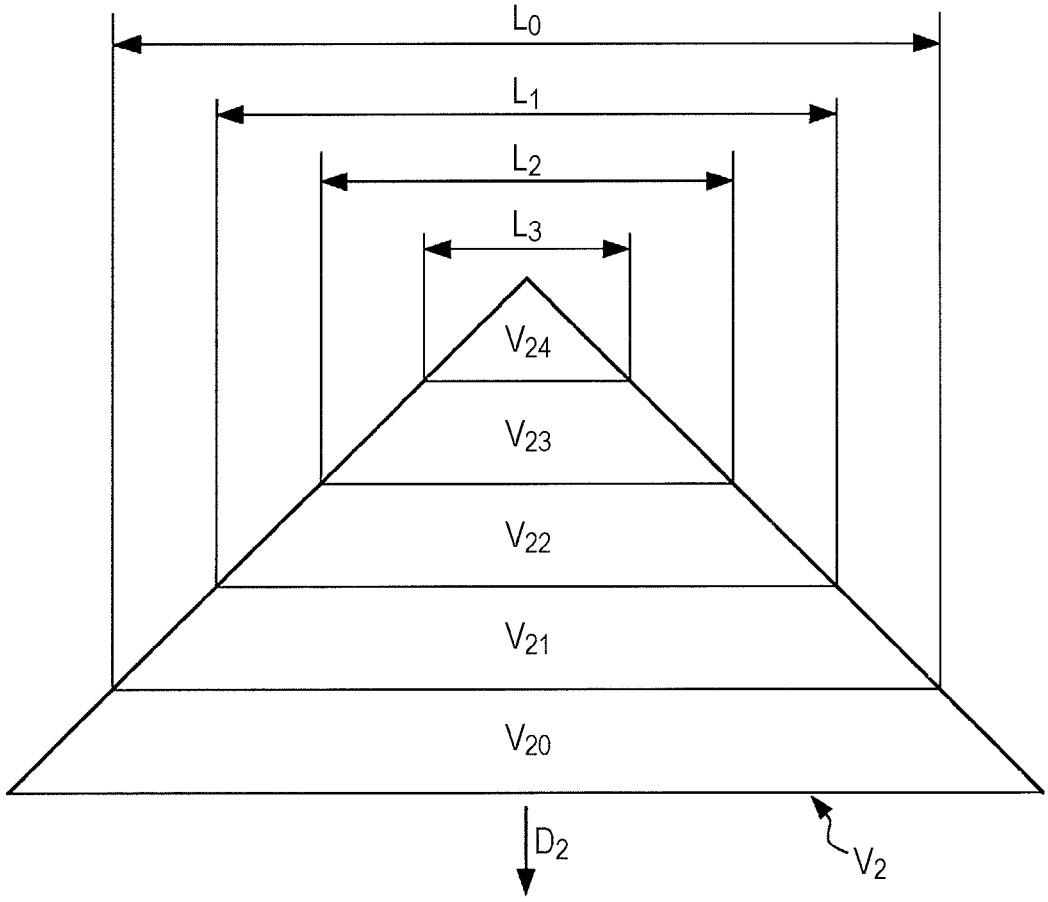
FIG. 13 illustrates the relationship between a flap and the distance between discharge rollers and the distances between protrusions in the axial direction.

FIG. 13 illustrates the relationship between the flap $V_2$ of the envelope V and the distances between the discharge rollers 102 and the distances between the protrusions in the axial direction. When the envelope V is discharged in the direction of arrow $D_2$ as the discharge rollers 102 rotate, the envelope body $V_1$ is discharged first and the flap $V_2$ is discharged next. The flap $V_2$ has a shape in which the width decreases in a direction opposite to the direction of arrow $D_2$. (Here, the term "width" refers to the length of the flap $V_2$ in a direction parallel to the folding line $V_3$ and perpendicular to the direction of arrow $D_2$.) That is, an edge E of the flap $V_2$ illustrated in FIG. 11 is an example of a trailing end of the envelope V having a shape in which a width decreases in a direction opposite to the discharge direction.

A region $V_{20}$ is a portion of the flap $V_2$ having a width equal to or larger than $L_0$. A region $V_{21}$ is a portion of the flap $V_2$ having a width smaller than $L_0$ and equal to or larger than $L_1$. A region $V_{22}$ is a portion of the flap $V_2$ having a width smaller than $L_1$ and equal to or larger than $L_2$. A region $V_{23}$ is a portion of the flap $V_2$ having a width smaller than $L_2$ and equal to or larger than $L_3$. A region $V_{24}$ is a portion of the flap $V_2$ having a width smaller than $L_3$.

Therefore, the discharge rollers 102 discharge the envelope V in the direction of arrow $D_2$ while the region $V_{20}$ of the flap $V_2$ is in contact with the discharge rollers 102. However, when the regions $V_{21}$ to $V_{24}$ that are located backward from the region $V_{20}$ in the direction of arrow $D_2$ (discharge direction) reach a space between the points $P_1$, the discharge rollers 102 become separated from the flap $V_2$, so that the discharge rollers 102 do not discharge the envelope V. After passing through the space between the points $P_1$, the regions $V_{21}$ to $V_{24}$ move in a direction toward the discharge rod 101. That is, the regions $V_{21}$ to $V_{24}$ fall toward the discharge rod 101 when the regions $V_{21}$ to $V_{24}$ pass through the space between points $P_1$. At this time, as illustrated in FIG. 10B, the flap $V_2$ rotates around the folding line $V_3$ in the direction of arrow $D_3$ and moves to a position illustrated by a two-dot chain line.

When the flap $V_2$ moves to the position illustrated by the two-dot chain line of FIG. 10B, the region $V_{21}$ of the flap $V_2$, which has a width smaller than $L_0$ and larger than $L_1$ as illustrated in FIG. 13, comes into contact with the first protrusions 111*a* and 111*b*, which are separated from each other by the distance $L_1$. As a result, the region $V_{21}$ of the flap $V_2$ is pushed by these protrusions in the direction of arrow $D_2$.

The region $V_{22}$ of the flap $V_2$, which has a width smaller than $L_1$ and larger than $L_2$, comes into contact with the second protrusions 112*a* and 112*b*, which are separated from each other by the distance $L_2$. As a result, the region $V_{22}$ of the flap $V_2$ is pushed by these protrusions in the direction of arrow $D_2$.

The region $V_{23}$ of the flap $V_2$, which has a width smaller than $L_2$ and larger than $L_3$, comes into contact with the third protrusions 113*a* and 113*b*, which are separated from each other by the distance $L_3$. As a result, the region $V_{23}$ of the flap $V_2$ is pushed by these protrusions in the direction of arrow $D_2$.

The region $V_{24}$ of the flap $V_2$ comes into contact with the fourth protrusion 114 and pushed in the direction of arrow $D_2$.

As described above, the first protrusions 111, the second protrusions 112, the third protrusions 113, and the fourth protrusion 114 are arranged in this order with an angle therebetween, the angle corresponding to a quarter of the way around the discharge rod 101 (90 degrees) in a direction opposite to the rotation direction of the discharge rod 101. Therefore, one of these pairs of the protrusions protrude from a region of the rotary shaft between the discharge rollers 102*a* and 102*b* and within a half of the way around the discharge rod 101 (180 degrees) backward in the rotation direction from a position at which the distance between parts of the discharge rollers 102*a* and 102*b* that come into contact with the trailing end of the envelope V (the edge E of the flap $V_2$) is the largest in the axial direction. That is, the pair of the protrusions protruding from this region are examples of a protrusion that protrudes from a region located between two roller members and within a half of the way around the rotary shaft backward in the rotation direction from a position at which the distance between the roller members is the largest. Due to such arrangement of the protrusions, the edge E comes into contact with the protrusions protruding from the region described above when one of the regions $V_{21}$ to $V_{24}$ passes through a space between the points $P_1$ and drops toward the discharge rod 101, and thereby the envelope V is discharged.

2-2-3. Hook of Protrusion

Next, the function of a hook of a protrusion will be described.

Figure 14A:
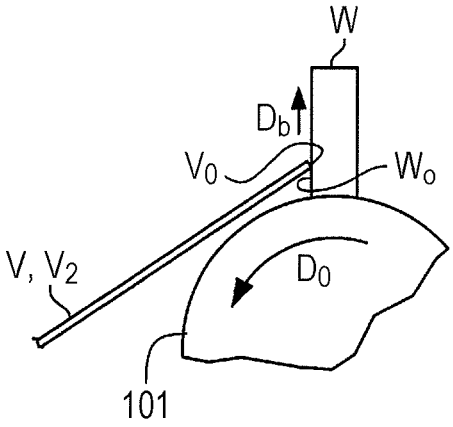
FIGS. 14A to 14C illustrate the function of a protrusion that does not have a hook.
Figure 14B:
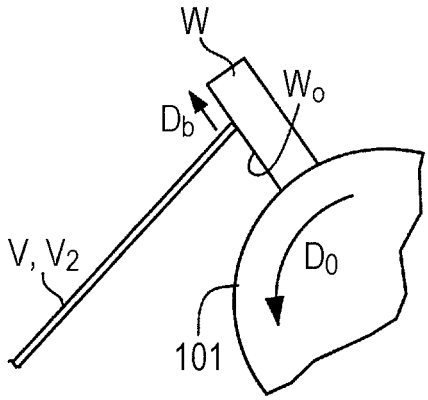
Figure 14C:
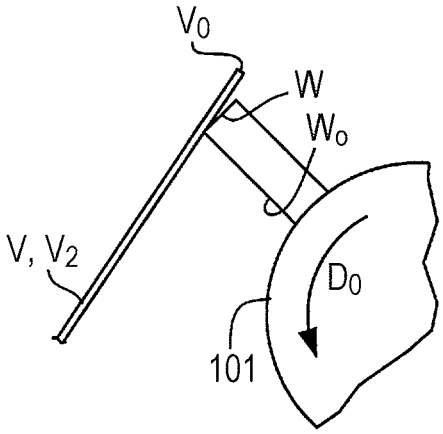

FIGS. 14A to 14C illustrate the function of a protrusion that does not have a hook. The second protrusions 112 and the fourth protrusion 114 do not have a hook. These protrusions, which do not have hooks, each include a flat plate W extending radially from the discharge rod 101 in a direction perpendicular to the axis O of the discharge rod 101 (Z-axis direction). The flat plate W is disposed on the peripheral surface of the discharge rod 101 and rotates when the discharge rod 101 rotates in the direction of arrow $D_0$. As illustrated in FIG. 14A, a surface $W_0$ of the flat plate W facing in the direction of arrow $D_0$ comes into contact with a trailing end $V_0$ of the envelope V (in this example, the flap $V_2$ of the envelope V) and pushes the envelope V in the rotation direction of the discharge rod 101. As illustrated in FIG. 14B, depending on the inclination of the envelope V with respect to the surface $W_0$, the trailing end $V_0$ of the envelope V may become displaced in the direction of arrow $D_b$, i.e., in a direction away from the discharge rod 101 along the surface $W_0$ due to inertia acting on the envelope V. In this case, as illustrated in FIG. 14C, if the trailing end $V_0$ moves beyond the length of the flat plate W in a direction in which the flat plate W extends, the surface $W_0$ may become detached from the trailing end $V_0$, and the protrusion may fail to discharge the envelope V.

Figure 15A:
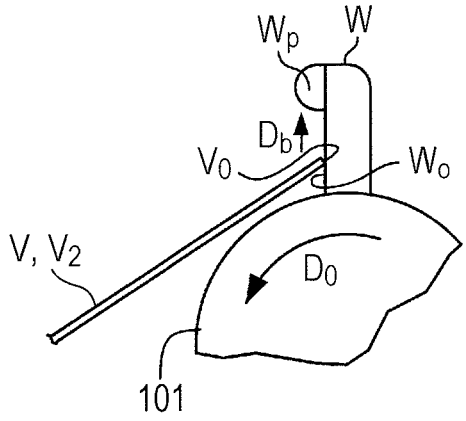
FIGS. 15A to 15C illustrate the function of a protrusion that has a hook.
Figure 15B:
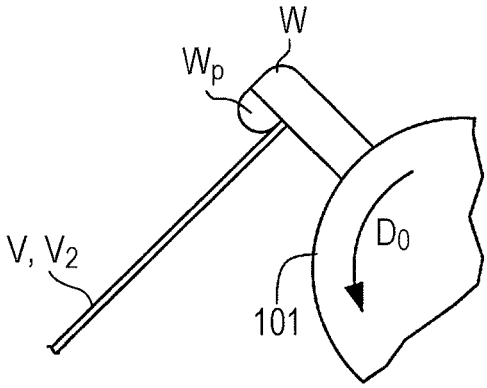
Figure 15C:
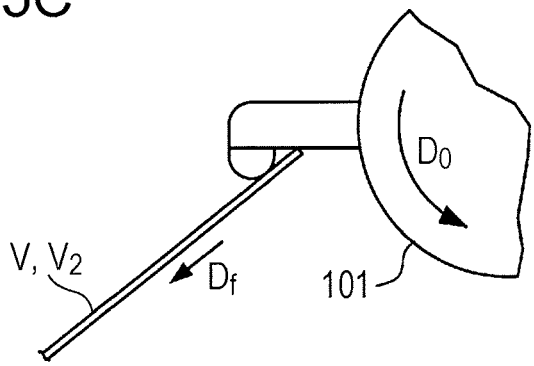

FIGS. 15A to 15C illustrate the function of a protrusion that has a hook. The first protrusions 111 and the third protrusions 113 each have a hook. These protrusions each include a flat plate W and a hook $W_p$. The flat plate W extends radially from the discharge rod 101 in a direction perpendicular to the axis O of the discharge rod 101 (Z-axis direction). The hook $W_p$ projects from the distal end of the flat plate W in the rotation direction of the discharge rod 101 (forward in the direction of arrow $D_0$) so as to be perpendicular to the flat plate W. That is, the protrusion having the hook $W_p$ is an example of a protrusion having a portion projecting in the rotation direction. As illustrated in FIG. 15A, when the surface $W_0$ of the flat plate W, which faces the direction of arrow $D_0$, comes into contact with the trailing end $V_0$ of the envelope V and pushes the envelope V in the rotation direction of the discharge rod 101, the trailing end $V_0$ becomes displaced in the direction of arrow $D_b$. However, as illustrated in FIG. 15B, the displaced trailing end $V_0$ comes into contact with the hook $W_p$, so that the trailing end $V_0$ is prevented from being moved further in a direction away from the discharge rod 101. Then, the flat plate W pushes the envelope V as the discharge rod 101 rotates in the direction of arrow $D_0$, and thereby the envelope V is discharged in the direction of arrow $D_f$ as illustrated in FIG. 15C.

As described above, the discharge unit 100 according to the second exemplary embodiment includes protrusions protruding from a region of the discharge rod 101 that is within a half of the way around the discharge rod 101 backward from a position at which the distance (in the axial direction) between the two discharge rollers 102 (102*a* and 102*b*), which are disposed on the discharge rod 101 at different positions in the axial direction, is the largest. Therefore, even if a medium fails to contact either of the two discharge rollers 102 if the medium has a trailing end portion having a shape in which the width decreases in a direction opposite to the discharge direction, the medium is discharged because the protrusions push the trailing end of the medium in the discharge direction.

Moreover, the protrusion having a hook holds and pushes the trailing end by using the hook when discharging "a medium having a width that decreases in a direction opposite to the discharge direction" (such as an envelope V), the performance of discharging a medium is improved.

The distance from the axis O of the discharge rod 101 to the end of the protrusion is smaller than the radius of the discharge rollers 102. Therefore, even if a medium is discharged in such a way that a surface of the medium on which an image has been formed (hereinafter referred to as "image forming surface") faces the discharge rollers 102, the protrusion do not come into contact with the image forming surface of the medium while the medium is being discharged by the discharge rollers 102. Therefore, it is not likely that an image is smeared by the protrusion.

3. Third Exemplary Embodiment

Figure 16:
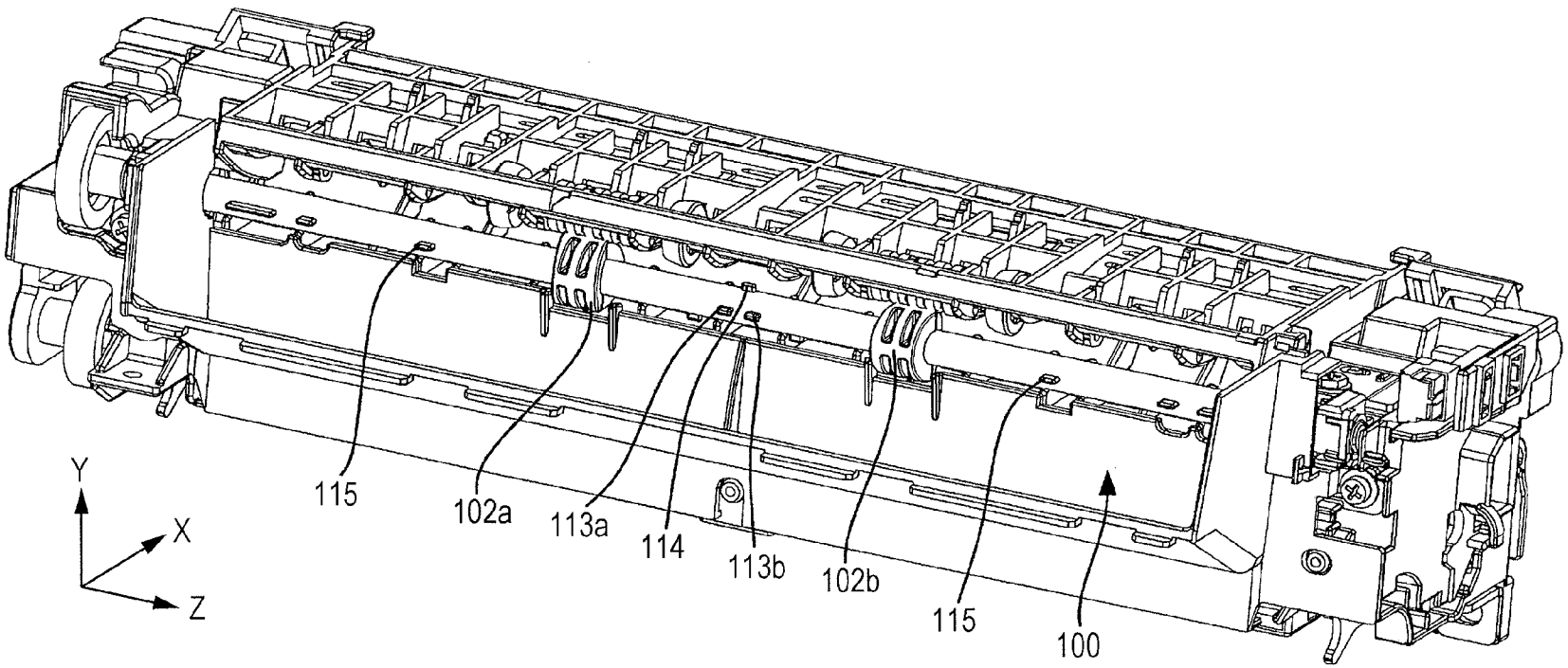
FIG. 16 is a perspective view of a discharge unit of an image forming apparatus according to a third exemplary embodiment of the present invention.

FIG. 16 is a perspective view of a discharge unit 100 of an image forming apparatus 1 according to a third exemplary embodiment of the present invention. The discharge unit 100 according to the third exemplary embodiment has a configuration that is the same as that of the discharge unit 100 according to the second exemplary embodiment, and further includes fifth protrusions 115. The image forming apparatus 1 according to the third exemplary embodiment will be described below with emphasis on the difference between the third exemplary embodiment and the second exemplary embodiment.

Figure 17A:
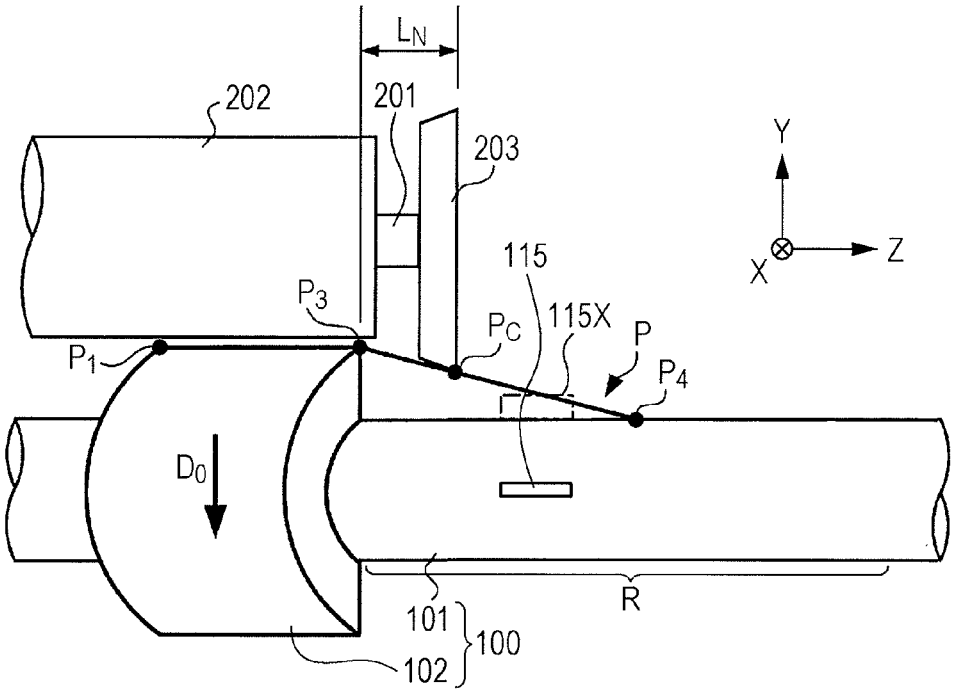
FIGS. 17A and 17B illustrate the configuration of the discharge unit and the vicinity of the discharge unit according to the third exemplary embodiment.
Figure 17B:
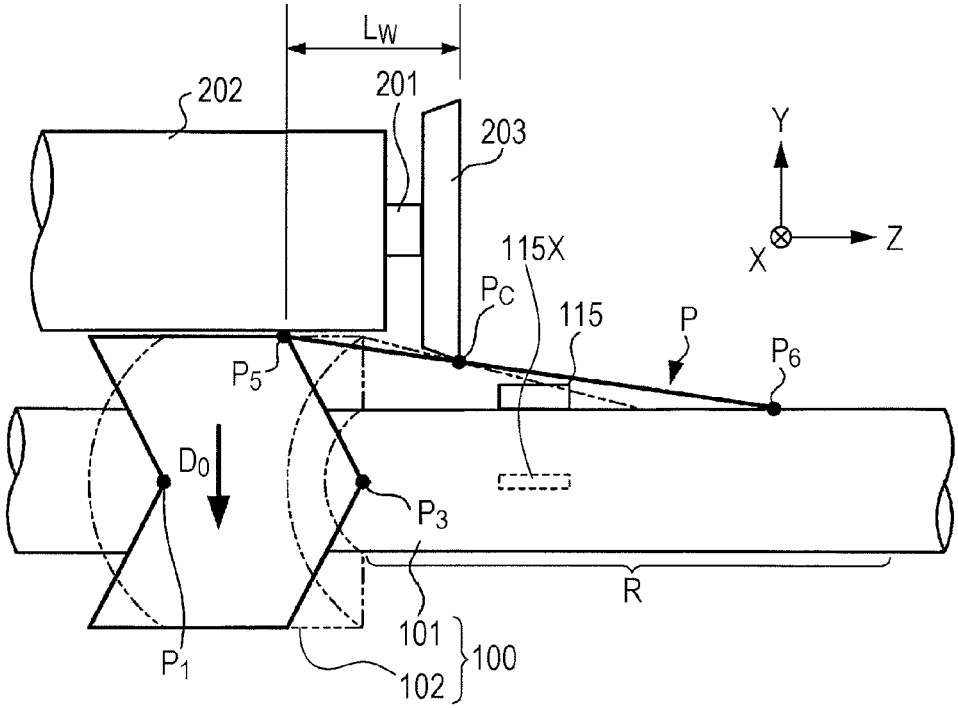

FIGS. 17A and 17B illustrate the configuration of the discharge unit 100 and the vicinity of the discharge unit 100 according to the third exemplary embodiment. FIGS. 17A and 17B illustrate the configuration seen in the X(+) direction. There are two discharge rollers 102, i.e., a discharge roller 102*b* illustrated in FIG. 17A and a discharge roller 102*a* that is not illustrated in FIG. 17A but disposed in the Z(−) direction. One of the fifth protrusions 115 is disposed in a region R of the discharge rod 101 that is not located between the two discharge rollers 102. The fifth protrusion 115 rotates as the discharge rod 101 rotates, and flips the trailing end of a medium P that has been corrugated and discharged by the discharge rollers 102. The fifth protrusion 115 applies a small impact to the medium P, and thereby the corrugation of the medium P is released.

FIG. 17A illustrates a state in which the discharge roller 102*b* rotates and the point $P_1$ is located at a position at which the discharge roller 102*b* and the auxiliary roller 202 nip the medium P therebetween. The discharge roller 102*b* and the discharge roller 102*a* (not shown) are symmetric to each other about a plane perpendicular to the Z-axis. The point $P_1$ is an endpoint of a line segment connecting a surface of the discharge roller 102*a* on the Z(+) side and a surface of the discharge roller 102*b* on the Z(−) side when the length of the line segment is the largest. Therefore, the point $P_1$ is one of points at which the distance between parts of the two discharge rollers 102 that are in contact with the trailing end of a medium P in the axial direction is the largest. A point $P_3$ is the intersection of an end surface of the discharge roller 102 and a straight line that extends toward the region R from the point $P_1$ in the axial direction of the discharge rod 101.

FIG. 17B illustrates a state in which the discharge roller 102*b* illustrated in FIG. 17A has rotated by 90 degrees in the direction of arrow $D_0$. At this time, the medium P is in contact with the discharge roller 102*b* at a point $P_5$ that is farthest in the Z(−) direction.

As illustrated in FIG. 17A, the fifth protrusion 115 is disposed at a position that is on the discharge rod 101 and that is not on an extension of a line connecting the point $P_1$ to the point $P_3$. That is, the fifth protrusion 115 is an example of a protrusion protruding from a region of the rotary shaft that is not located between the two roller members and that is not located in the axial direction from a position at which the distance between the two roller members is the largest. Here, it is hypothetically assumed that a protruding piece 115*x* is disposed on the discharge rod 101 on an extension of a line connecting the point $P_1$ to the point $P_3$. The protruding piece 115*x* has the same size as the fifth protrusion 115, is disposed at a position the same as that of the fifth protrusion 115 in the axial direction of the discharge rod 101, but is disposed at a position different from that of the fifth protrusion 115 in the rotation direction of the discharge rod 101.

In the state illustrated in FIG. 17A, the corrugation roller 203 presses the medium P in a direction toward the discharge rod 101 at the point $P_C$, and the discharge roller 102 presses the medium P in a direction away from the discharge rod 101 at the point $P_3$. In the state illustrated in FIG. 17B, the corrugation roller 203 presses the medium P in a direction toward the discharge rod 101 at the same point $P_C$, and the discharge roller 102 presses the medium P in a direction away from the discharge rod 101 at a point $P_5$ that is displaced in the Z(−) direction from the point $P_3$.

The distance from the point $P_3$ to the point $P_C$ in the axial direction is a distance $L_N$, and the distance from the point $P_5$ to the point $P_C$ in the axial direction is a distance $L_W$ that is larger than the distance $L_N$. Therefore, the angle between the axial direction and a line connecting the point $P_5$ to the point $P_C$ is smaller than the angle between the axial direction and a line connecting the point $P_3$ to the point $P_C$.

As illustrated in FIG. 17A, a straight line passing through the point $P_3$ and the point $P_C$ intersects the discharge rod 101 at a point $P_4$. As illustrated in FIG. 17B, a straight line passing through the point $P_5$ and the point $P_C$ intersects the discharge rod 101 at a point $P_6$ that is in the Z(+) direction from the point $P_4$.

The line connecting the point $P_3$ and the point $P_4$ and the line connecting the point $P_5$ and the point $P_6$ are in the path of the medium P. Therefore, the protruding piece 115*x* disposed at the position described above obstructs passage of the medium P as illustrated in FIG. 17A. In contrast, the fifth protrusion 115 does not obstruct passage of the medium P. For this reason, the fifth protrusion 115 of the discharge unit 100 is not disposed at the position of the protruding piece 115*x*.

4. Modifications

The exemplary embodiments described above may be modified as follows. The modifications may be used in combination.

4-1. Image Forming Unit

In the exemplary embodiments described above, the image forming unit 500 forms an image on a surface of a medium by using an electrophotographic process. However, an image may be formed on a medium by using another process. For example, an image may be formed by using an inkjet method.

4-2. Protrusion (1) In the second exemplary embodiment described above, four types of protrusions protruding from the discharge rod 101, i.e., the first protrusions 111, the second protrusions 112, the third protrusions 113, and the fourth protrusion 114 are disposed at four positions in the rotation direction of the discharge rod 101 in a region of the discharge rod 101 between the discharge rollers 102*a* and 102*b*. However, there may be three, five, or more than five types of protrusions.

(2) Among the four types of protrusions, the first protrusions 111 and the third protrusions 113 each have a hook. However, it is only necessary that at least one type of the protrusions may have hooks.

(3) Among the plural types of protrusions, only two types of protrusions disposed at positions that are rotationally symmetric to each other about the axis of the discharge rod 101 may have hooks. In this case, as compared with the case where more than three types of protrusions have hooks, the discharge rod 101 may be easily removed from a mold when the discharge rod 101 and the protrusions are integrally formed by injecting a resin into the mold. The discharge rod 101 and the protrusions need not be integrally formed. For example, the protrusions may be bonded to the peripheral surface of the discharge rod 101 after the discharge rod 101 has been made by being molded.

(4) The dispositions of the protrusions in the axial direction (Z-axis direction) may be the same. It is only necessary that the distances between the protrusions in the axial direction be smaller than the distance between the discharge rollers.

(5) In the exemplary embodiments described above, the protrusions, except for the fourth protrusion 114, are grouped into pairs of protrusions that are separated from each other in the axial direction. The pairs of protrusions are arranged on the discharge rod 101 in such a way that the distance between the protrusions decreases in a direction opposite to the rotation direction of the discharge rod 101 (in the order of $L_1$, $L_2$, and $L_3$). With such a configuration, the discharge unit 100 has the following function.

That is, as the discharge rod 101 rotates, the tailing end of a medium first comes into contact with the first protrusions 111 separated from each other by the distance $L_1$ and is pushed toward the stacker unit 300. Because the trailing end of the medium has a width decreasing in a direction opposite to the discharge direction, the width of a part of the medium closest to the discharge rod 101 is smaller than $L_1$ after the medium has been pushed toward the stacker unit 300. Because the protrusions are arranged in the order described above, after the first protrusions 111 come into contact with the medium, the second protrusions 112, which are separated from each other by the distance $L_2$ smaller than the distance $L_1$, come into contact with the trailing end of the medium. Thus, although the width is smaller than $L_1$, the second protrusions 112 push the trailing end of the medium in the discharge direction.

Likewise, the third protrusions 113, which are arranged so as to be separated from each other by the distance $L_3$ that is smaller than $L_2$, come into contact with the trailing end of the medium, as with the second protrusions 112. Then, the fourth protrusion 114, which is a single protrusion disposed in the axial direction, comes into contact with the trailing end of the medium, as with the third protrusions 113. Thus, the distance between the protrusions that push the trailing end of the medium decreases as the discharge rod 101 rotates, and thereby the protrusions successively push the tailing end of the medium while the width of the medium decreases as the medium is discharged further.

(6) The protrusions need not be grouped into pairs of protrusions separated from each other in the axial direction. It is only necessary that plural protrusions be disposed on the discharge rod 101 in a region between the discharge rollers 102*a* and 102*b* and protrude from at least two positions that are different with respect to the axial direction. As long as protrusions that protrude from two or more different positions with respect to the axial direction push the trailing end of the medium P, the discharge mechanism according to the exemplary embodiments is capable of preventing the medium P from being rotated around a contact point between the medium P and one of the protrusions.

(7) In the exemplary embodiments described above, the hook protrudes from the leading end of the protrusion in the rotation direction of the discharge rod 101. However, the hook may protrude from a part of the protrusion other than the leading end. The angle between the hook and the direction in which the protrusion extends need not be a right angle and may be an acute angle or an obtuse angle. The protrusion need not extend along a straight line passing through the axis O of the discharge rod 101, and the protrusion may be curved.

Figure 18A:
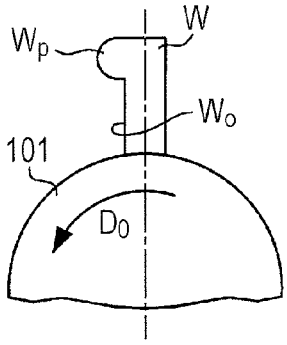
FIGS. 18A to 18F illustrate modifications of a protrusion that has a hook.
Figure 18B:
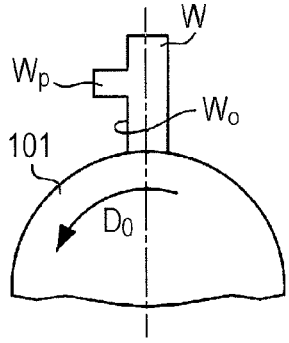

FIGS. 18A to 18F illustrate modifications of a protrusion that has a hook. In the exemplary embodiments described above, a protrusion having a hook has a shape illustrated in FIG. 18A. That is, in the exemplary embodiments described above, a protrusion has a hook $W_p$ projecting in the rotation direction of the discharge rod 101 (forward in the direction of arrow $D_0$) from the distal end of the flat plate W extending along a line passing through the axis O (not shown) of the discharge rod 101. However, as illustrated in FIG. 18B, a protrusion may have a hook $W_p$ projecting in the rotation direction of the discharge rod 101 from a middle position of the flat plate W with respect to the direction in which the flat plate W extends (i.e., a position between the distal end and the proximal end).

Figure 18C:
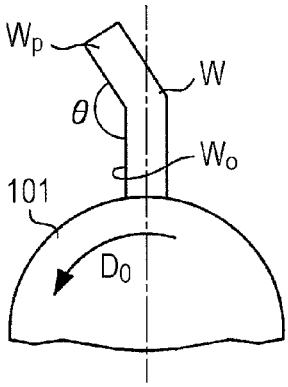
Figure 18D:
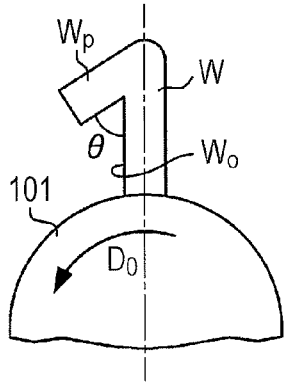

As illustrated in FIG. 18D, the angle θ between the hook $W_p$ and the flat plate W (the angle between a surface of the hook $W_p$ closer to the axis O of the discharge rod 101 and a surface $W_0$ of the flat plate W facing the rotation direction of the discharge rod 101) may be an acute angle. However, as illustrated in FIG. 18C, the angle may be an obtuse angle if friction between the flat plate W and the medium P is comparatively large. It is only necessary that the protrusion have a configuration such that the surface $W_0$ of the flat plate W facing the rotation direction of the discharge rod 101 pushes a medium P in the discharge direction and the hook $W_p$ holds the trailing end of the medium P so that the trailing end may not be released in the direction in which the flat plate W extends.

Figure 18E:
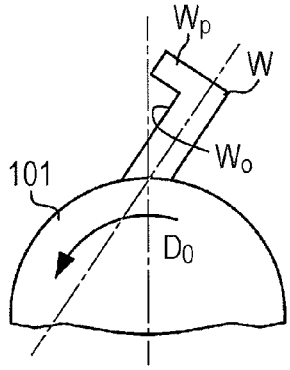
Figure 18F:
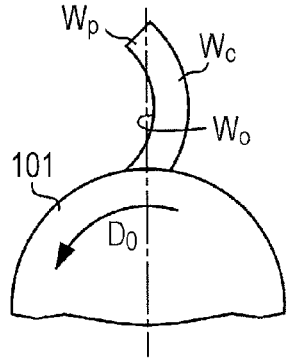

As illustrated in FIG. 18E, an extension of a line oriented in a direction in which the flat plate W extends need not pass through the axis O (not shown) of the discharge rod 101. As illustrated in FIG. 18F, the protrusion may include a curved plate $W_C$ instead of the flat plate W. In this case, the curved plate $W_C$ has a surface $W_0$ that is concave with respect to the rotation direction of the discharge rod 101, and the surface $W_0$ and a hook $W_p$ on the distal end of the curved plate $W_C$ hold the trailing end of a medium P and push the medium P in the rotation direction.

4-3. Discharge Rod

In the exemplary embodiments described above, the discharge rollers 102 and the protrusions are disposed on the same discharge rod 101. However, it is only necessary that the discharge rollers 102 and the protrusions be rotatable around the axis O that extends in the Z-axis direction. Therefore, the discharge rollers 102 and the protrusions may be disposed on different rods. If, for example, the discharge rollers 102 and the protrusions are disposed on different rods, the discharge unit 100 may include a transmission mechanism that meshes with gears disposed on the outer peripheral portions of both of these rods, and the discharge rollers 102 and the protrusions may rotate around the same axis O. In this case, the discharge unit 100 may be configured in such a way that the transmission mechanism rotates the discharge rollers 102 and the protrusions at different speeds.

4-4. Discharge Roller (1) In the exemplary embodiments described above, one of the end surfaces of the discharge roller 102 has a dogleg shape in a side view seen in a certain direction and has a fan-like shape in a side view seen in a direction that is rotated from the certain direction by 90 degrees. However, the shape of the discharge roller 102 is not limited thereto. For example, the end surface of the discharge roller 102 may have a sinusoidal shape in a side view seen in a certain direction. That is, the entirety of the end surface of the discharge roller 102 may be curved.

(2) In the exemplary embodiments described above, the discharge roller 102 has a shape formed of two oblique cylinders that are cut along their axes and that are joined together along the cut surfaces so as to be symmetric to each other about the cut surfaces. However, the shape of the discharge roller 102 may be an oblique cylinder. It is only necessary that the discharge roller 102 have a cylindrical shape that is coaxial with the discharge rod 101 and that has an end surface including a part that is inclined with respect to the discharge rod 101.

(3) In the exemplary embodiments described above, the discharge rollers 102*a* and 102*b* are disposed on the discharge rod 101 at different positions in the axial direction. However, only one discharge roller 102 may be disposed on the discharge rod 101, or three or more discharge rollers 102 may be disposed at different positions in the axial direction. Even if only one discharge roller 102 is used, as long as a medium P is corrugated and has concave portions and as long as the contact point with the medium P is displaced in the axial direction so as to approach the concave portions of the medium P when the discharge roller 102 rotates, the discharge roller 102 pushes the trailing end of the medium P in the discharge direction and thereby discharges the medium P.

(4) In the exemplary embodiments described above, the length of the peripheral surface of the discharge roller 102 in the axial direction is constant regardless of a position thereon. However, the shape of the peripheral surface is not limited thereto. That is, the peripheral surface of the discharge roller 102 may have a shape in which the length in the axial direction is different at at least two positions in the rotation direction. Also in this case, as long as a part the peripheral surface of the discharge roller 102 that is in contact with a medium is continuously displaced in the axial direction and in the rotation direction of the rotary shaft when the discharge roller 102 is rotated, the probability of the medium being damaged is reduced as compared with the case where this part is not displaced and the roller member has a shape in which a cross section along a plane perpendicular to the axis is not circular.

4-5. Auxiliary Roller

In the exemplary embodiments described above, the auxiliary rods 201 are rod-like members disposed so as to be separated from the discharge rod 101 in the Y(+) direction by a predetermined distance, the axis of the auxiliary rods 201 are parallel to the axis of the discharge rod 101, the auxiliary rollers 202 rotate around the auxiliary rod 201, and the auxiliary rollers 202 are disposed on the auxiliary rod 201 at positions facing the discharge rollers 102*a* and 102*b*. In this case, each of the auxiliary rollers 202 is disposed in the Y(+) direction from the discharge roller 102. However, the auxiliary roller 202 may be disposed in a different direction.

For example, each of the auxiliary rollers 202 may be disposed at a position displaced in the X(+) direction from the position the Y(+) direction from the discharge roller 102. Because the direction of arrow $D_0$ has a component in the X(−) direction at a nip position at which a medium P is nipped, the position of the auxiliary roller 202 is upstream, with respect to the rotation direction of the discharge roller 102, of the highest point of the discharge roller 102 with respect to the direction of gravity. It is only necessary that the position of each of the auxiliary rods 201 relative to the discharge rollers 102 be determined such that the medium P is on the discharge rollers 102 when the medium P has passed through the nip position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and according to order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A discharge mechanism comprising:

a rotary shaft;

a roller member having a peripheral surface that is coaxial with the rotary shaft, rotates together with the rotary shaft, and discharges a medium that is in contact with the peripheral surface, the peripheral surface having a constant width in an axial direction of the rotary shaft, and a cross sectional position changing in the axial direction as the roller member rotates; and a deforming unit that deforms the medium in such a way that a part of the medium, the part being not in contact with the peripheral surface, passes through a position that is closer to the rotary shaft than the peripheral surface is, wherein a part of the peripheral surface, the part being in contact with the medium, is continuously displaced in an axial direction and in a rotation direction of the rotary shaft when the roller member is rotated.

2. The discharge mechanism according to claim 1, further comprising:

a roller body that nips the medium between the roller body and the roller member, wherein a length of a region over which the roller body and the roller member nip the medium, the length being in the axial direction, does not change when the roller member rotates.

3. The discharge mechanism according to claim 2, wherein the number of the roller members is at least two, and the roller members are disposed at different positions in the axial direction, and wherein a distance between parts of the roller members that are located adjacent to each other, the parts being in contact with the medium and the distance being in the axial direction, continuously changes when the roller members are rotated.

4. The discharge mechanism according to claim 3, further comprising:

a protrusion protruding from a region of the rotary shaft, the region being located between the two roller members and within half of a way around the rotary shaft backward in the rotation direction from a position at which the distance is the largest.

5. The discharge mechanism according to claim 4, wherein a distance from an axis of the rotary shaft to a distal end of the protrusion is smaller than a distance from the axis to the peripheral surface.

6. The discharge mechanism according to claim 4, wherein the protrusion has a portion that projects in the rotation direction.

7. The discharge mechanism according to claim 3, further comprising:

a protrusion protruding from a region of the rotary shaft, the region not being located between the two roller members and not being located in the axial direction from a position at which the distance is the largest.

8. The discharge mechanism according to claim 7, wherein a distance from an axis of the rotary shaft to a distal end of the protrusion is smaller than a distance from the axis to the peripheral surface.

9. The discharge mechanism according to claim 7, wherein the protrusion has a portion that projects in the rotation direction.

10. The discharge mechanism according to claim 1, wherein the number of the roller members is at least two, and the roller members are disposed at different positions in the axial direction, and wherein a distance between parts of the roller members that are located adjacent to each other, the parts being in contact with the medium and the distance being in the axial direction, continuously changes when the roller members are rotated.

11. The discharge mechanism according to claim 10, further comprising:

a protrusion protruding from a region of the rotary shaft, the region not being located between the two roller members and not being located in the axial direction from a position at which the distance is the largest.

12. The discharge mechanism according to claim 11, wherein a distance from an axis of the rotary shaft to a distal end of the protrusion is smaller than a distance from the axis to the peripheral surface.

13. The discharge mechanism according to claim 11, wherein the protrusion has a portion that projects in the rotation direction.

14. The discharge mechanism according to claim 10, further comprising:

a protrusion protruding from a region of the rotary shaft, the region being located between the two roller members and within half of a way around the rotary shaft backward in the rotation direction from a position at which the distance is the largest.

15. The discharge mechanism according to claim 14, wherein a distance from an axis of the rotary shaft to a distal end of the protrusion is smaller than a distance from the axis to the peripheral surface.

16. The discharge mechanism according to claim 14, wherein the protrusion has a portion that projects in the rotation direction.

17. The discharge mechanism according to claim 1, wherein the roller member has a cylindrical shape that is coaxial with the rotary shaft and that has an end surface including a part inclined with respect to the rotary shaft.

18. The discharge mechanism according to claim 17, wherein the roller member has an oblique cylindrical shape that is coaxial with the rotary shaft.

19. An image forming apparatus comprising:

an image forming unit that forms an image on a medium; and the discharge mechanism according to claim 1, the discharge mechanism discharging the medium on which the image forming unit has formed the image.

20. The discharge mechanism according to claim 1, wherein the roller member comprises a deformable portion which deforms during rotation of the roller member.

* * * * *